US011982044B2

(12) United States Patent
Lee

(10) Patent No.: US 11,982,044 B2
(45) Date of Patent: May 14, 2024

(54) INTEGRATED DEVICE FOR DRYING, FLATTENING, AND FOLDING TEXTILE CLOTH

(71) Applicant: FUZHOU UNIVERSITY OF INTERNATIONAL STUDIES AND TRADE, Fuzhou (CN)

(72) Inventor: Chouyuan Lee, Fuzhou (CN)

(73) Assignee: FUZHOU UNIVERSITY OF INTERNATIONAL STUDIES AND TRADE, Fuzhou (CN)

( * ) Notice: Subject to any disclaimer, the term of this patent is extended or adjusted under 35 U.S.C. 154(b) by 273 days.

(21) Appl. No.: 17/715,968

(22) Filed: Apr. 8, 2022

(65) Prior Publication Data

US 2022/0325464 A1 Oct. 13, 2022

(30) Foreign Application Priority Data

Apr. 13, 2021 (CN) ..... 202110393497.8

(51) Int. Cl.
*D06F 63/02* (2006.01)
*D06F 60/00* (2009.01)
*D06F 89/00* (2006.01)

(52) U.S. Cl.
CPC ..... *D06F 63/02* (2013.01); *D06F 60/00* (2013.01); *D06F 89/00* (2013.01)

(58) Field of Classification Search
CPC ..... D06F 63/02; D06F 63/00; D06F 60/00; D06F 67/08; D06F 67/10; D06F 69/00; D06F 69/02; D06F 89/00
See application file for complete search history.

(56) References Cited

U.S. PATENT DOCUMENTS 2,137,505 A * 11/1938 Osgood ..... B27D 3/04 100/154
2,256,327 A * 9/1941 Parkes ..... D06F 89/00 38/9
3,460,898 A * 8/1969 Fleissner ..... D06B 5/06 34/115
3,634,956 A * 1/1972 Behn ..... D06F 69/02 38/44
4,377,045 A * 3/1983 Aurensan ..... D06F 69/02 38/18
4,932,139 A * 6/1990 Lehtinen ..... D21F 5/004 34/454

(Continued)

*Primary Examiner* — Ismael Izaguirre

(57) ABSTRACT

An integrated device for drying, flattening, and folding textile cloth includes a workbench. Two groups of two symmetrically arranged first fixed rods are fixedly connected with a lower wall of the workbench. Connecting blocks are fixedly arranged on top ends of opposite sides of each two symmetrically arranged first fixed rods. Two groups of two oppositely arranged rotating rollers are provided. One end of each of the connecting blocks is rotatably connected with a corresponding rotating roller. A fixed shaft is fixedly connected between each two oppositely arranged rotating rollers. The rotating rollers are connected by rotating belts. Rotating rods are arranged between the two groups of rotating rollers. A drying device is arranged on the rotating rods. A flattening device is arranged on an upper wall of the workbench. A folding device is arranged on one side of the rotating belts.

6 Claims, 2 Drawing Sheets

(56) References Cited

U.S. PATENT DOCUMENTS

| | | | | |
|---|---|---|---|---|
| 4,980,981 | A * | 1/1991 | Naidoo | D06F 69/00 38/144 |
| 5,632,830 | A * | 5/1997 | Marschke | B32B 37/1027 156/359 |
| 5,778,555 | A * | 7/1998 | Lehtinen | F26B 13/105 34/95 |
| 6,746,389 | B2 * | 6/2004 | Selle | B31B 70/982 493/405 |

* cited by examiner

INTEGRATED DEVICE FOR DRYING, FLATTENING, AND FOLDING TEXTILE CLOTH

TECHNICAL FIELD

The present disclosure relates to a field of textile technology, and in particular to an integrated device for drying, flattening, and folding textile cloth.

BACKGROUND

Cloth is mainly composed of plant fibers. Textile cloth is divided into three categories: clothing textile cloth, decorative textile cloth, and industrial textile cloth according to a purpose. The clothing textile cloth comprises various textile fabrics for making clothing, as well as textile accessories (such as sewing threads, elastic bands, collar linings, lining etc.), knitted garments, gloves, socks, and etc.

After the cloth is manufactured, it needs to be dried, flattened, folded, etc., and then packed in a box, so that the cloth can be stored for a longer time. Moreover, these processes make the cloth take up less space when packing. A speed of a conventional drying device is too slow when drying the cloth, and at the same time, the cloth is easily wrinkled, which brings trouble to a flattening treatment of the cloth, and therefore is not conducive to folding the cloth, and makes it difficult to pack the cloth. In addition, flattening of the cloth is usually processed manually, which makes a processing efficiency poor, and makes effects not ideal.

SUMMARY

The present disclosure provides an integrated device for drying, flattening, and folding textile cloth to solve defects in the prior that a speed of a conventional drying device is too slow when drying cloth, which makes the cloth easily to be wrinkled and brings trouble to a flattening treatment of the cloth, and therefore is not conducive to folding the cloth, and makes it difficult to pack the cloth. The present disclosure further solves a defect that a processing of the cloth is usually carried out manually, which makes processing efficiency poor and make an effect not ideal.

In order to achieve above purposes, the present disclosure adopts the following technical solutions:

The present disclosure provides an integrated device for drying, flattening, and folding textile cloth. The integrated device comprises a workbench. Two groups of first fixed rods are fixedly connected with a left side and a right side of a lower wall of the workbench. Each of the two groups of first fixed rods comprises two symmetrically arranged first fixed rods. Connecting blocks are fixedly arranged on top ends of opposite sides of each two symmetrically arranged first fixed rods. Two groups of rotating rollers are provided. Each of the two groups of rotating rollers comprises two oppositely arranged rotating rollers. One end of each of the connecting blocks is rotatably connected with a corresponding rotating roller. A fixed shaft is fixedly connected between each two oppositely arranged rotating rollers. The two groups of rotating rollers are connected by rotating belts. A plurality of rotating rods are arranged between the two groups of rotating rollers. A drying device is arranged on the plurality of rotating rods. A flattening device is arranged on an upper wall of the workbench. A folding device is arranged on one side of the rotating belts.

Optionally, the drying device comprises a plurality of fixed blocks. The plurality of fixed blocks are separately fixedly connected with a side wall of a corresponding rotating rod. The plurality of fixed blocks are arranged between the rotating belts. One end of each of the plurality of fixed blocks is fixedly connected with a fan blade. A heating wire is arranged on an upper surface of each fan blade. A rotating block is fixedly connected with a bottom end of each of the plurality of rotating rods. Rotating grooves one-to-one corresponding to the plurality of rotating blocks are provided on the lower wall of the workbench. The integrated device further comprises a transmission device arranged in the integrated device.

Optionally, the transmission device comprises first bevel gears. Each of the first bevel gears is fixedly sleeved on a corresponding fixed shaft. Each of the first bevel gears is arranged on one side of the corresponding fixed shaft. Each of the first bevel gears is engaged with a second bevel gear. Each second bevel gear is arranged on a bottom end of a corresponding first bevel gear. Each second bevel gear is fixedly connected with a second fixed rod. One end of each second fixed rod is rotatably connected with the lower wall of the workbench. A first rotating wheel is fixedly sleeved on each second fixed rod. A second rotating wheel is fixedly sleeved on one of the plurality of rotating rods close to a corresponding second bevel gear arranged in a left side of the workbench. A height of the second rotating wheel corresponds to a height of each first rotating wheel. The second rotating wheel is connected with a corresponding first rotating wheel by a first connecting belt. A third rotating wheel is fixedly sleeved on a lower end of each of the plurality of rotating rods. The third rotating wheels are fixedly connected through a second connecting belt. Support plates are connected with one side of the first fixed rods away from the first bevel gears. A motor is fixedly arranged on a top portion of each of the support plates. An output end of each motor is fixedly connected with a rotating post. One end of each rotating post penetrates through corresponding first fixed rods and corresponding connecting blocks and is fixedly connected with each two oppositely arranged rotating rollers.

Optionally, a top end of each of the plurality of rotating rods is rotatably connected with a same connecting plate. A top end of the connecting plate is flush with a surface of each of the rotating belts. The connecting plate is arranged in a scale shape. Gaps are defined between two sides of the connecting plate and the rotating belts.

Optionally, the flattening device comprises a plurality of connecting rods. The plurality of connecting rods are fixedly connected with an upper wall of the workbench. A connecting shaft is fixedly connected with a bottom end of each of the plurality of connecting rods. A flattening roller is rotatably sleeved on each connecting shaft. Each flattening roller is made of rubber. A bottom end of each flattening roller contacts a top end of a corresponding rotating belt.

Optionally, the folding device comprises a folding box. A feeding port is defined on one side of the folding box. A cloth conveying board is fixedly connected to the feeding port. One end of the cloth conveying board contact a surface of each of the rotating belts. An opening is defined on another side of the folding box.

Compared with the prior art, the integrated device of the present disclosure adopts automatic processing, which has high efficiency and good processing effect. The integrated device is equipped with a plurality of fans, so that the cloth is dried when it moves on the rotating belts, which is beneficial to drying of the cloth, thereby prolonging a storage time of the cloth. Therefore, the integrated device is beneficial to production and use of the cloth. In addition, drying and flattening of the cloth are carried out at the same time, so that the cloth is flattened by the flattening device while drying. Thus, the cloth is not wrinkled, and a processing time of the cloth is shortened. Furthermore, when the flattening device flattens the cloth, the cloth is compressed, and moisture in the cloth is squeezed out, which makes the drying of the cloth quick, and is facilitates to packing of the cloth.

IN THE DRAWINGS

1—workbench; 2—first fixed rod; 3—connecting block; 4—rotating roller; 5—rotating belt; 6—rotating rod; 7—fixed block; 8—fan blades; 9—second rotating wheel; 10—first connecting belt; 11—third rotating wheel; 12—second connecting belt; 13—connecting plate; 14—rotating block; 15—rotating groove; 16—connecting rod; 17—connecting shaft; 18—flattening roller; 19—cloth conveying plate; 20—folding box; 21—first bevel gear; 22—fixed shaft; 23—second bevel gear; 24—second fixed rod; 25—first rotating wheel; 26—motor; 27—support plate; 28—rotating post.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments.

It should be understood in the description of the present disclosure that terms such as "upper", "lower", "front", "rear", "top", "bottom", "inner", "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

Figure 1:
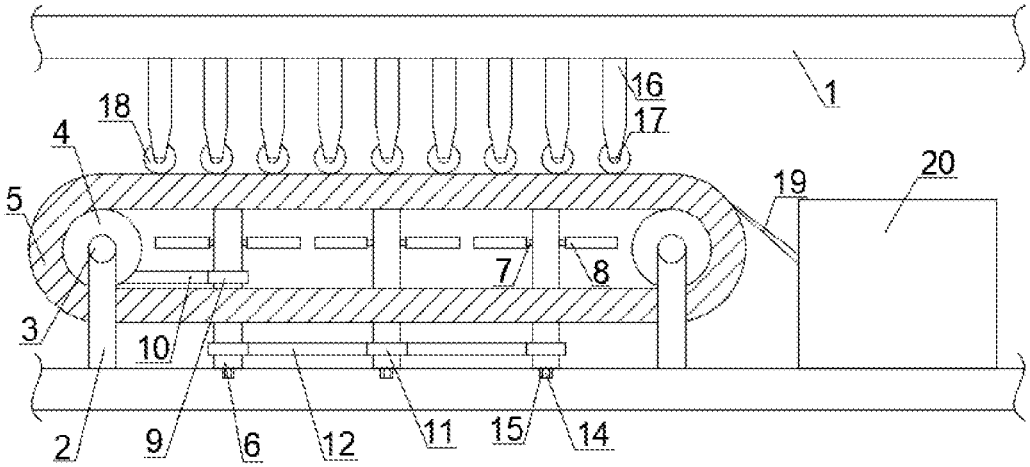
FIG. 1 is a schematic diagram of an integrated device for drying, flattening, and folding textile cloth of the present disclosure.
Figure 2:
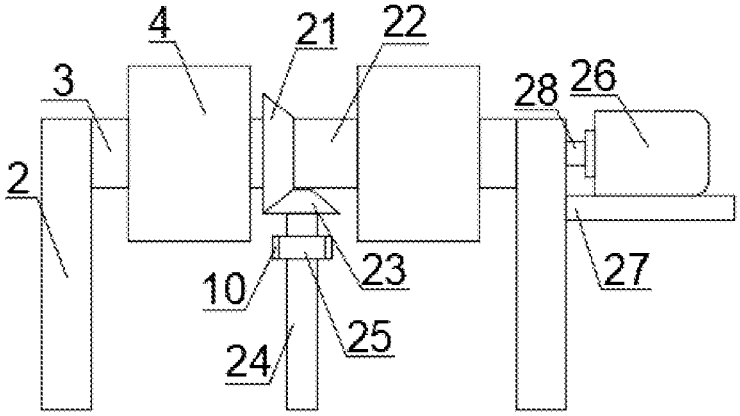
FIG. 2 is a schematic diagram of transmission structures of the integrated device for drying, flattening, and folding textile cloth of the present disclosure.
Figure 3:
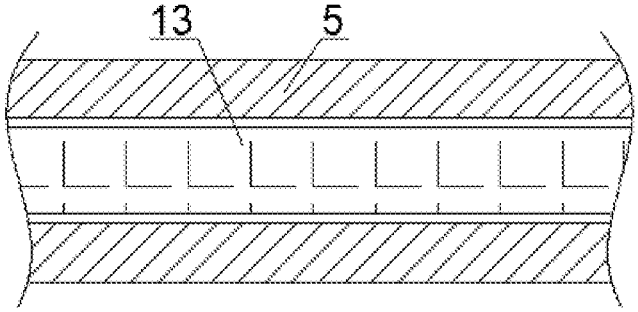
FIG. 3 is a top schematic diagram of a rotating belt of the integrated device for drying, flattening, and folding textile cloth of the present disclosure.
Figure 4:
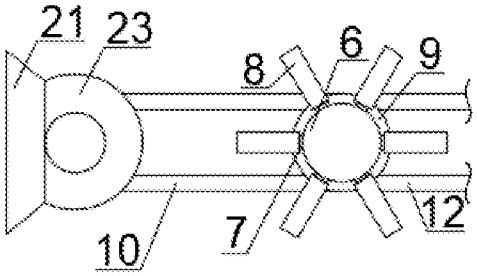
FIG. 4 is a top schematic diagram of the transmission structures of the integrated device for drying, flattening, and folding textile cloth of the present disclosure.

As shown in FIGS. 1-4, an integrated device for drying, flattening, and folding textile cloth of the present disclosure comprises a workbench 1. Two groups of first fixed rods 2 are fixedly connected with a left side and a right side of a lower wall of the workbench 1. Each of the two groups of first fixed rods 2 comprises two symmetrically arranged first fixed rods 2. Connecting blocks 3 are fixedly arranged on top ends of opposite sides of each two symmetrically arranged first fixed rods 2. Two groups of rotating rollers 4 are provided. Each of the two groups of rotating rollers 4 comprises two oppositely arranged rotating rollers 4. One end of each of the connecting blocks 3 is rotatably connected with a corresponding rotating roller 4. A fixed shaft 22 is fixedly connected between each two oppositely arranged rotating rollers 4. Each two oppositely arranged rotating rollers 4 are connected by rotating belts 5. A plurality of rotating rods 6 are arranged between the two groups of rotating rollers. A top end of each of the plurality of rotating rods 6 is rotatably connected with a same connecting plate 13. A top end of the connecting plate 13 is flush with a surface of each of the rotating belts 5. The connecting plate 13 is arranged in a scale shape. Gaps are defined between two sides of the connecting plate 13 and the rotating belts 5. Therefore, hot air blown by a drying device is blown out from the gaps and gaps between scales of the connecting plate 13 to dry cloth. Meanwhile, under compression of a flattening device, moisture in the cloth is left from the gaps, so that the cloth is dried faster. The drying device is arranged on the plurality of rotating rods 6. A flattening device is arranged on an upper wall of the workbench 1. A folding device is arranged on one side of the rotating belts 5.

The drying device comprises a plurality of fixed blocks 7. The plurality of fixed blocks 7 are separately fixedly connected with a side wall of a corresponding rotating rod 6. The plurality of fixed blocks 7 are arranged between the rotating belts 5. One end of each of the plurality of fixed blocks 7 is fixedly connected with a fan blade 8. A heating wire is arranged on an upper surface of each fan blade 8. A rotating block 14 is fixedly connected with a bottom end of each of the plurality of rotating rods 6. Rotating grooves 15 one-to-one corresponding to the plurality of rotating blocks 14 are provided on the lower wall of the workbench 1. The integrated device further comprises a transmission device arranged in the integrated device.

The transmission device comprises first bevel gears 21. Each of the first bevel gears 21 is fixedly sleeved on a corresponding fixed shaft 22. Each of the first bevel gears 21 is arranged on one side of the corresponding fixed shaft 22. Each of the first bevel gears 21 is engaged with a second bevel gear 23. Each second bevel gear23 is arranged on a bottom end of a corresponding first bevel gear 21. Each second bevel gear 23 is fixedly connected with a second fixed rod 24. One end of each second fixed rod 24 is rotatably connected with the lower wall of the workbench 1. A first rotating wheel 25 is fixedly sleeved on each second fixed rod 24. A second rotating wheel 9 is fixedly sleeved on one of the plurality of rotating rods 6 close to a corresponding second bevel gear 23 arranged on a left side of the workbench. A height of the second rotating wheel 9 corresponds to a height of each first rotating wheel 25. The second rotating wheel 9 is connected with a corresponding first rotating wheels 25 by a first connecting belt 10. A third rotating wheel 11 is fixedly sleeved on a lower end of each of the plurality of rotating rods 6. The third rotating wheels 11 are fixedly connected through a second connecting belt 12. Support plates 27 are connected with one side of the first fixed rods 2 away from the first bevel gears 21. A motor 26 is fixedly arranged on a top portion of each of the support plates 27. An output end of each motor 26 is fixedly connected with a rotating post 28. One end of each rotating post 28 penetrates through corresponding first fixed rods 2 and corresponding connecting blocks 3 and is fixedly connected with each two oppositely arranged rotating rollers 4.

When the motors 26 are turned on, the output end of each motor 26 drives the corresponding rotating post 28 to rotate, so that each two oppositely arranged rotating rollers 4 fixedly connected with each rotating post 28 rotate and each fixed shaft 22 fixedly connected between two corresponding rotating rollers 4 rotates. Then each of the first bevel gears 21 fixedly sleeved on the corresponding fixed shaft 22 rotates, which drives each second bevel gear 23 engaged with each of the first bevel gears 21 to rotate, so that each second fixed rod 24 fixedly connected with the corresponding second bevel gear 23 rotates and drives each of the first rotating wheel 25 fixedly sleeved on each second fixed rod 24 to rotate.

The first rotating wheel 25 arranged in the left side of the workbench drives the second rotating wheel 9 to rotate through the first connecting belt 10, so that the one of the plurality of rotating rods 6 fixedly connected with the second rotating wheel rotates. One of the third rotating wheels 11 that fixedly connected to a lower end of the one of the plurality of rotating rods 6 rotates and the all the third rotating wheels rotate under action of the second connecting belt 12, so that the plurality of rotating rods 6 rotate, and each of the plurality of fixed blocks 7 and each fan blades 8 fixedly connected to the side wall of each of the plurality rotating rods 6 rotates to blow air upwards. Each heating wire arranged on the upper surface of each fan blade 8 heat the air, so that the fan blades 8 blow out hot air and the cloth is dried as soon as possible.

The flattening device comprises a plurality of connecting rods 16. The plurality of connecting rods 16 are fixedly connected with an upper wall of the workbench 1. A connecting shaft 17 is fixedly connected with a bottom end of each of the plurality of connecting rods 16. A flattening roller 18 is rotatably sleeved on each connecting shaft 17. Each flattening roller 18 is made of rubber. A bottom end of each flattening roller 18 contacts a top end of a corresponding rotating belt 5. When the cloth passes under the flattening rollers 18, the flattening rollers 18 compress the cloth, so that the cloth is flattened.

The folding device comprises a folding box 20. A feeding port is defined on one side of the folding box. A cloth conveying board 19 is fixedly connected to the feeding port. One end of the cloth conveying board 19 contact a surface of each of the rotating belts 5. An opening is defined on another side of the folding box 20. The cloth is conveyed into the folding box 20 from the feeding port through the cloth conveying plate 19, and then the cloth is folded in the folding box 20. When taking out the cloth, the opening is opened, and the folded cloth is taken out from the opening.

In the present disclosure, when the motors 26 are turned on, the output end of each motor 26 drives the corresponding rotating post 28 to rotate, so that the rotating rollers 4 fixedly connected with the rotating posts 28 rotate and each fixed shaft 22 fixedly connected between two corresponding rotating rollers 4 rotates. Then each of the first bevel gears 21 fixedly sleeved on the corresponding fixed shaft 22 rotates, which drives each second bevel gear 23 engaged with each of the first bevel gears 21 to rotate, so that each second fixed rod 24 fixedly connected with the corresponding second bevel gear 23 rotates and drives one of the first rotating wheels 25 arranged in the left side of the workbench that fixedly sleeved on a corresponding second fixed rod 24 to rotate. The first rotating wheel 25 arranged in the left side of the workbench drive the second rotating wheel 9 to rotate through the first connecting belt 10, so that one of the rotating rods 6 fixedly connected with the second rotating wheel 9 rotates to make a corresponding third rotating wheel 11 fixedly connected to the lower end of the one of the plurality of rotating rods 6 rotates. The third rotating wheels 11 rotate under action of the second connecting belt 12, so that each of the plurality of rotating rods 6 rotates, and each of the plurality of fixed blocks 7 and each fan blades 8 fixedly connected to the side wall of each of the plurality rotating rods 6 rotates to blow air upwards. Each heating wire arranged on the upper surface of each fan blade 8 heat the air, so that the fan blades 8 blow out hot air and the cloth is dried as soon as possible. When the cloth passes under the flattening rollers 18, the flattening rollers 18 compress the cloth, so that the cloth is flattened. The cloth is conveyed into the folding box 20 from the feeding port through the cloth conveying plate 19, and then the cloth is folded in the folding box 20. When taking out the cloth, the opening is opened, and the folded cloth is taken out from the opening.

Foregoing descriptions are only optional embodiments of the present disclosure and are not intended to limit the present disclosure. Any modification, equivalent replacement, or improvement within the disclosed technical scope of the present disclosure made according to technical solutions and inventive concepts of the present disclosure by those skilled in the art should be included in the protection scope of the present disclosure.

What is claimed is:

1. An integrated device for drying, flattening, and folding textile cloth, comprising: a workbench, wherein two groups of first fixed rods are fixedly connected with a left side and a right side of a lower wall of the workbench; each of the two groups of first fixed rods comprises two symmetrically arranged first fixed rods; connecting blocks are fixedly arranged on top ends of opposite sides of each two symmetrically arranged first fixed rods;

wherein two groups of rotating rollers are provided; each of the two groups of rotating rollers comprises two oppositely arranged rotating rollers; one end of each of the connecting blocks is rotatably connected with a corresponding rotating roller; a fixed shaft is fixedly connected between each two oppositely arranged rotating rollers; the two groups of rotating rollers are connected by rotating belts; a plurality of rotating rods are arranged between the two groups of rotating rollers; a drying device is arranged on the plurality of rotating rods; a flattening device is arranged on an upper wall of the workbench; a folding device is arranged on one side of the rotating belts.

2. The integrated device for drying, flattening, and folding textile cloth according to claim 1, wherein the drying device comprises a plurality of fixed blocks; the plurality of fixed blocks are separately fixedly connected with a side wall of a corresponding rotating rod; the plurality of fixed blocks are arranged between the rotating belts; one end of each of the plurality of fixed blocks is fixedly connected with a fan blade; a heating wire is arranged on an upper surface of each fan blade; a rotating block is fixedly connected with a bottom end of each of the plurality of rotating rods; rotating grooves one-to-one corresponding to the plurality of rotating blocks are provided on the lower wall of the workbench; wherein a transmission device is arranged in the integrated device.

3. The integrated device for drying, flattening, and folding textile cloth according to claim 2, wherein the transmission device comprises first bevel gears, each of the first bevel gears is fixedly sleeved on a corresponding fixed shaft; each of the first bevel gears is arranged on one side of the corresponding fixed shaft; each of the first bevel gears is engaged with a second bevel gear; each second bevel gear is arranged on a bottom end of a corresponding first bevel gear; each second bevel gear is fixedly connected with a second fixed rod, one end of each second fixed rod is rotatably connected with the lower wall of the workbench; a first rotating wheel is fixedly sleeved on each second fixed rod; a second rotating wheel is fixedly sleeved on one of the plurality of rotating rods close to a corresponding second bevel gear arranged in a left side of the workbench; a height of the second rotating wheel corresponds to a height of each first rotating wheel; the second rotating wheel is connected with a corresponding first rotating wheel by a first connecting belt; a third rotating wheel is fixedly sleeved on a lower end of each of the plurality of rotating rods; the third rotating wheels are fixedly connected through a second connecting belt; support plates are connected with one side of the first fixed rods away from the first bevel gears; a motor is fixedly arranged on a top portion of each of the support plates; an output end of each motor is fixedly connected with a rotating post; one end of each rotating post penetrates through corresponding first fixed rods and corresponding connecting blocks and is fixedly connected with each two oppositely arranged rotating rollers.

4. The integrated device for drying, flattening, and folding textile cloth according to claim 1, wherein a top end of each of the plurality of rotating rods is rotatably connected with a same connecting plate; a top end of the connecting plate is flush with a surface of each of the rotating belts; the connecting plate is arranged in a scale shape; gaps are defined between two sides of the connecting plate and the rotating belts.

5. The integrated device for drying, flattening, and folding textile cloth according to claim 1, wherein the flattening device comprises a plurality of connecting rods; the plurality of connecting rods are fixedly connected with an upper wall of the workbench; a connecting shaft is fixedly connected with a bottom end of each of the plurality of connecting rods; a flattening roller is rotatably sleeved on each connecting shaft; each flattening roller is made of rubber; a bottom end of each flattening roller contacts a top end of a corresponding rotating belt.

6. The integrated device for drying, flattening, and folding textile cloth according to claim 1, wherein the folding device comprises a folding box; a feeding port is defined on one side of the folding box; a cloth conveying board is fixedly connected to the feeding port; one end of the cloth conveying board contact a surface of each of the rotating belts; an opening is defined on another side of the folding box.

* * * * *